US005989304A

United States Patent [19]

Ozaki et al.

[11] Patent Number: 5,989,304

[45] Date of Patent: Nov. 23, 1999

[54] IRON-BASED POWDER COMPOSITION FOR POWDER METALLURGY EXCELLENT IN FLOWABILITY AND COMPACTIBILITY AND METHOD

[75] Inventors: Yukiko Ozaki; Satoshi Uenosono; Kuniaki Ogura, all of Chiba, Japan

[73] Assignee: Kawasaki Steel Corporation, Kobe, Japan

[21] Appl. No.: 08/973,142

[22] PCT Filed: Jan. 9, 1997

[86] PCT No.: PCT/JP97/00029

§ 371 Date: Nov. 28, 1997

§ 102(e) Date: Nov. 28, 1997

[87] PCT Pub. No.: WO98/05454

PCT Pub. Date: Dec. 2, 1998

[30] Foreign Application Priority Data

Aug. 5, 1996 [JP] Japan ..... 8-223181

[51] Int. Cl.[6] ..... B22F 1/00

[52] U.S. Cl. ..... 75/252

[58] Field of Search ..... 75/252, 231, 255; 419/34, 35

[56] References Cited

U.S. PATENT DOCUMENTS

| | | | |
|---|---|---|---|
| 4,601,765 | 7/1986 | Soileau et al. | 148/104 |
| 5,135,566 | 8/1992 | Sakuranda et al. | 75/255 |
| 5,256,185 | 10/1993 | Semel et al. | 75/255 |
| 5,368,630 | 11/1994 | Luk | 75/252 |
| 5,432,223 | 7/1995 | Champagne et al. | 524/431 |
| 5,641,920 | 6/1997 | Hens et al. | 75/228 |
| 5,766,304 | 6/1998 | Uenosono et al. | 75/252 |

FOREIGN PATENT DOCUMENTS

| | | |
|---|---|---|
| 56-136901 | 10/1981 | Japan . |
| B-58-28321 | 6/1983 | Japan . |
| 59-47301 | 3/1984 | Japan . |
| 62-282418 | 12/1987 | Japan . |
| 63-104408 | 5/1988 | Japan . |
| 1-161803 | 6/1989 | Japan . |
| 1-165701 | 6/1989 | Japan . |
| 2-47201 | 2/1990 | Japan . |
| 2-57602 | 2/1990 | Japan . |
| 2-156002 | 6/1990 | Japan . |
| 3-162502 | 7/1991 | Japan . |
| 6-145701 | 5/1994 | Japan . |
| 7-103404 | 11/1995 | Japan . |

*Primary Examiner*—Ngoclan Mai
*Attorney, Agent, or Firm*—Oliff & Berridge, PLC

[57] ABSTRACT

An iron-based powder composition for powder metallurgy excellent in flowability and compactibility is produced in accordance with a method comprising the steps of: adding to iron-based and alloying powders, for a primary mixing, a surface treatment agent, and in addition, for a secondary mixing, a fatty acid amide and at least one lubricant, wherein the lubricant has a melting point higher than that of the fatty acid amide and can be a thermoplastic resin, a thermoplastic elastomer, and inorganic or organic compounds having a layered crystal structure; heating and stirring up a mixture after the secondary mixing at a temperature above a melting point of the fatty acid amide to melt the fatty acid amide; cooling, while mixing, the mixture subjected to the heating and stirring process so that the alloying powder and a lubricant having a melting point higher than the fatty acid amide adhere to a surface of the iron base powder subjected to the surface treatment by an adhesive force of the melt; and adding at the time of the cooling, for a tertiary mixing, a metallic soap and at least one thermoplastic resin or thermoplastic elastomer powders and inorganic or organic compounds having layered crystal structure. The mixture is heated to about 423K and loaded into a die for compaction.

19 Claims, No Drawings

IRON-BASED POWDER COMPOSITION FOR POWDER METALLURGY EXCELLENT IN FLOWABILITY AND COMPACTIBILITY AND METHOD

TECHNICAL FIELD

The present invention relates to an iron-based powder composition for powder metallurgy in which lubricant, graphite powder, copper powder and the like are added and mixed beforehand, and more particularly to an iron-based powder composition for powder metallurgy which in normal handling undergoes little segregation of the additive materials and dust generation and has excellent flowability and compactibility in a wide temperature range over the order of the room temperature to 473 K.

BACKGROUND ART

Hitherto, iron-based powder compositions for powder metallurgy have been produced by a mixing method in which alloying powders such as copper, graphite, and iron phosphide powders, are mixed with an iron powder, and according to the necessity, in addition to the powders for improving the machinability a lubricant such as zinc stearate, aluminium stearate, and lead stearate is mixed. Such a lubricant has been adopted in view of a homogeneous mixing with a metal powder, an easy decomposition and a removability at the time of sintering.

Recently, as a requirement of higher strength for sintering manufactures is increased, as disclosed in Japanese Patent Application Laid Open Gazette (Kokai) Hei. 2-156002, Japanese Patent Publication (Kokoku) Hei. 7-103404, U.S. Pat. No. 5,256,185 and U.S. Pat. No. 5,368,630, there is proposed a warm compaction technology which permits higher density and higher strength of compacts by means of performing a compaction while metal powders are heated. It is considered for the lubricant used in such a compaction procedure that a lubricity at the time of heating is important as well as the homogeneous mixing with a metal powder, the easy decomposition and the removability at the time of sintering.

Specifically, a mixing of mixtures of a plurality of lubricants having mutually different melting points with metal powders serves, at the time of a warm compaction, to melt part of the lubricants, uniformly spread the lubricants between iron and/or alloying metal particles, and decrease frictional resistances among the particles and between a compact and dies, so that a compactibility is improved.

However, such a metal powder composition involves the following drawbacks. First, a raw material mixture undergoes segregation. Regarding the segregation, since the metal powder composition contains powders having different sizes, shapes and densities, segregation occurs readily during transport after mixing and upon charging the powder composition into hoppers, or upon discharging the powder composition from the hoppers or during molding treatments. For example, it is well known that segregation of a mixture of iron-based powder and graphite powder occurs within a transport vehicle owing to vibrations during trucking, so that the graphite powder rises to the top. It is also known as to graphite charged into a hopper that the concentration of graphite powder differs at the beginning, middle, and end of the discharging operation from the hopper owing to segregation within the hopper.

These segregations cause fluctuations in the composition of products of the powder metallurgy; fluctuations in dimensional changes and strength become large, and this causes the production of inferior products.

The flow rate of the powder composition increases as a result of the increased specific surface area of the mixture, since graphite and other powders are fine powders. Such increases in flow rate is disadvantageous because it decreases the production speed of green compacts by decreasing charging speed of the powder composition into die cavities for compaction.

As technologies for preventing segregation of such a powder composition, there are known methods based on selection of an appropriate binder as disclosed in Japanese Patent Application Laid Open Gazette (Kokai) Sho. 56-136901 and Japanese Patent Publication (Kokoku) Sho. 58-28321. However, these methods involve such a drawback that if the quantity of binder added is increased so that segregation of the powder composition is sufficiently improved, the flow rate of the powder composition is increased.

The present inventors proposed, in Japanese Patent Application Laid Open Gazette (Kokai) Hei. 1-165701 and Japanese Patent Application Laid Open Gazette (Kokai) Hei. 2-47201, methods in which a melt composed of the combination of an oil and a metal soap or wax, melted together is selected as a binder. These methods make it possible to sufficiently reduce segregation of a powder composition and dust generation, and also to improve the flowability. However, these methods involve such a problem that the flowability of the powder composition varies with the passage of time owing to means for preventing segregation mentioned above. Hence, the present inventors developed a method in which a melt composed of the combination of a high-melting point of oil and a metal soap, melted together is selected as a binder, as proposed in Japanese Patent Application Laid Open Gazette (Kokai) Hei. 2-57602. According to this method, the melt has a small change of elapse, and a change of elapse of flow rate of the powder composition is reduced. However, this method involves another drawback such that apparent density of the powder composition varies, since a high-melting point of saturated fatty acid of solid state and a metal soap are mixed with iron-based powders at the room temperature.

In order to solve this problem, the present inventors proposed, in Japanese Patent Application Laid Open Gazette (Kokai) Hei. 3-162502, a method in which after a surface of the iron-based powder is coated with a fatty acid, an additive material is adhered to the surface of the iron-based powder by means of a melted-together binder composed of a fatty acid and a metal soap, and further a metal soap is added to the outer surface of the iron-based powder.

DISCLOSURE OF THE INVENTION

The problems of segregation and dust generation have been considerably solved in accordance with technologies disclosed in Japanese Patent Application Laid Open Gazette (Kokai) Hei. 2-57602 and Japanese Patent Application Laid Open Gazette (Kokai) Hei. 3-162502. However, it is still insufficient as to the flowability, particularly, at the time of heating in a so-called warm compaction in which powder compositions are heated until about 423 K and charged into a heated die cavity to be molded.

Also according to the methods disclosed in Japanese Patent Application Laid Open Gazette (Kokai) Hei. 3-162502, Japanese Patent Application Laid Open Gazette (Kokai) Hei. 7-103404, U.S. Pat. No. 5,256,185 and U.S. Pat. No. 5,368,630, in which a compactibility in the warm compaction is improved, it is difficult to provide the excellent flowability in the warm compaction of the powder composition, since a low-melting point of lubricant component forms a liquid cross-linking among the particles.

Inferior flowability causes not only hindrance in productivity of the green compact as mentioned above, but also fluctuations in density distribution of the green compact because of disunity in charging into dies for compaction. This causes fluctuations in properties of the sintered body. Solutions to this problem are subjects.

The first subject of the present invention is to provide an iron-based powder composition for powder metallurgy having excellent flowability at not only the room temperature but also in the warm compaction, and is also to provide a method of producing the composition.

Technologies concerning the warm compaction disclosed in Japanese Patent Application Laid Open Gazette (Kokai) Hei. 3-162502 contributes to a production of an iron-based powder compact having high density and high strength, but involves such a drawback that an ejection force at the time of compaction is high. Thus, there are problems such that defects occur on a surface of the compact, and the lifetime of compacting dies is decreased.

The second subject of the present invention is to provide an iron-based powder composition for powder metallurgy improved in compactibility, which is capable of reducing an ejection force at the time of compaction at the room temperature and in the warm compaction, and is also to provide a method of producing the composition.

First, in order to solve the first subject of the present invention, the present inventors studied a cause in which the flow rate of metal powders mixed with organic compounds such as a lubricant and the like is extremely increased as compared with metal powders mixed with no organic compound. As a result, the present inventors noticed that the reason why the flow rate is increased is that frictional resistances between the iron and/or alloying particles and adhesion between the iron or alloying particles and the organic compound is increased, and thus examined as to how the frictional resistances and the adhesion can be decreased. Now the present inventors find a countermeasure that surfaces of the iron and/or alloying powders are treated or coated with a certain type of organic compound which is chemically stable until a high temperature range (about 473 K), so that the frictional resistances between iron-based and/or alloying particles are reduced, and further a surface potential of the surfaces of the iron-based and/or alloying particles is selected to approach a surface potential of the organic compound (excepting for the surface treatment agent) so as to suppress a contact-charging between the iron-based or alloying particles and the organic compound at the time of mixing, thereby prohibiting adhesions of particles due to the electrostatic force.

Further, in order to improve the compactibility, the present inventors grasp the effect of various solid-state lubricants, and find the fact that inorganic or organic compound having layered crystal structure, in the room temperature and warm compactions, and thermoplastic resin or elastomer which undergo plastic deformation at the range over 373 K, in warm compaction, serve to reduce the ejection force at the time of compaction so that the compactibility can be improved.

Furthermore, the present inventors also find the effect that coating the surfaces of iron-based and/or alloying particles with the surface treatment agent for improvement of the flow rate serves secondarily to reduce the ejection force at the time of compaction so that the compactibility can be improved.

The present invention relates to iron-based powder composition for powder metallurgy excellent in flowability and compactibility, and a method of producing the composition, characterized in that the iron-based powder composition contains an iron-based powder, an alloying powder, a binding agent and a lubricant; part or whole of the composition is powders coated with a surface treatment agent; and as the lubricant, there are included inorganic or organic compound having layered crystal structure, or a thermoplastic resin or an elastomer.

It is preferable that the surface treatment agent is one or more types selected from among organosilicon compounds, a titanate coupling agent, a fluorine-contained silicon silane coupling agent and mineral oil. Organosilicon compounds imply a general term of such a type of compound that a part of carbon of an organic compound is replaced by silicon. Particularly, as the organosilicon compounds, organoalkoxysilane, organosilazane or silicon oil is effective for the present invention, and in the present invention, the organosilicon compounds are restricted to those compounds.

It is preferable that the inorganic compound having the layered crystal structure is one selected from among graphite, carbon fluoride and $MoS_2$. Further, it preferable that the organic compound having the layered crystal structure is melamine-cyanuric acid adduct or N-alkylasparatic acid-β-alkylester.

It is preferable that the thermoplastic resin is anyone selected from among polystyrene, nylon, polyethyrene and fluorine-contained resin, and their particle diameter is 30 $\mu$m or less.

It is preferable that the thermoplastic elastomer (TPE) is one selected from among a styrene block copolymer (SBC), a thermoplastic elastomer olefin (TEO), a thermoplastic elastomer polyamide (TPAE) and a silicone elastomer, and their particle diameter is 30 $\mu$m or less.

These iron-based powder composition can be produced as follows.

That is, there is provided a method of producing an iron-based powder composition, comprising steps of: coating at least one of iron-based powder and alloying powder with a surface treatment agent at a room temperature; adding to the iron-based and alloying powder subjected to a surface treatment, for a primary mixing, a fatty acid amide and at least one lubricant, wherein the lubricant has a melting point higher than that of the fatty acid amide and is selected from the group comprising, a thermoplastic resin, a thermoplastic elastomer, and inorganic or organic compounds having layered crystal structure; heating and stirring up a composition after the primary mixing at a temperature over a melting point of the fatty acid amide to melt the fatty acid amide; mixing up and cooling the mixture subjected to the heating and stirring process so that the alloying powder and a lubricant having a melting point higher than the fatty acid amide adhere to a surface of the iron-based powder subjected to the surface treatment by an adhesive force of the melt; and adding at the time of the cooling, for a secondary mixing, a metallic soap and at least one type selected from a group comprising thermoplastic resin or thermoplastic elastomer powders and inorganic or organic compounds having layered crystal structure.

It is acceptable that the surface treatment mentioned above may be carried out after the primary mixing. That is, there is provided a method of producing an iron-based powder composition, comprising steps of: adding to the iron-based powder, for a primary mixing, a fatty acid amide and at least one lubricant, wherein the lubricant has a melting point higher than that of the fatty acid amide and is selected from the group comprising, a thermoplastic resin, a thermoplastic elastomer, and inorganic or organic compounds having layered crystal structure; heating and stirring up a mixture after the primary mixing at a temperature over a melting point of the fatty acid amide to melt the fatty acid amide; cooling the composition subjected to the heating and stirring process so that the alloying powder and a lubricant having a melting point higher than the fatty acid amide adhere to a surface of the iron-based powder subjected to the surface treatment by an adhesive force of the melt, and adding and mixing a surface treatment agent in a temperature range not less than 373 K and not more than a melting point of the fatty acid amide; and adding at time of the cooling, for a secondary mixing, metallic soap and at least one type selected from a group comprising thermoplastic resin or thermoplastic elastomer powders and inorganic or organic compounds having layered crystal structure.

In this case, it is preferable that the surface treatment agent is one or more types selected from a group composed of organosilicon compounds, a titanate-contained coupling agent, a fluorine-contained silicon silane coupling agent and mineral oil.

Containing at least a copper powder or a cuprous oxide powder in the alloying powder contained in the iron-based powder composition according to the present invention makes it possible to increase the strength of the sintered body.

The use of a melt of one type of fatty acid amide, a partial melt of two or more types of fatty acid amide having mutually different melting points, or a melted-together binder composed of a fatty acid amide and a metallic soap, as the binding agent contained in the iron-based powder composition according to the present invention, may effectively prevent segregation and dust generation in and by the iron-based powder composition, and in addition improve the flowability. As the amide-contained lubricant, N,N'-Ethylenebis(stearamide) is particularly preferable.

DETAILED DESCRIPTION OF PREFERRED EMBODIMENTS

Hereinafter, the present invention will be described in technical concept and effect.

As mentioned above, the flowability of iron-based and alloying powders mixed with an organic compound such as a lubricant and the like is extremely decreased as compared with iron-based and alloying powders mixed with no organic compound. The reason why the flow rate is increased is that frictional resistances between the iron-based and alloying powders and adhesions between the iron-based or alloying powders and the organic compound are increased. Thus, there is provided a countermeasure that surfaces of the iron-based and/or alloying powders are treated (coated) with a certain type of organic compound, so that the frictional resistances between the iron-based and alloying powders are reduced, and further a surface potential of the surfaces of the iron-based and alloying powders is selected to approach a surface potential of the organic compound (excepting for the surface treatment agent) so as to suppress a contact-charging between the hereto-particles at the time of mixing, thereby prohibiting adhesions of particles due to the electrostatic force. Thus, it is possible to improve the flowability of the mixed powders by a compound effect of both. Specifically, it is possible to ensure the stable flowability over a temperature range from the room temperature to 475 K so that the technology is applied to the warm compaction.

Next, there will be described more in detail the reason why the flowability is improved over the broad temperature range by means of coating surfaces of iron-based and/or alloying powders with organosilicon compounds, a titanate-contained coupling agent, a fluorine-contained silicon silane coupling agent or mineral oil.

Here, organosilicon compounds are restricted to organoalkoxysilane, organosilazane or silicone oil. The above-mentioned surface treatment agents have a lubricating function owing to a bulky molecular structure and in addition they are chemically stable in the high temperature region as compared with fatty acid, mineral oil and the like. Thus, those surface treatment agents exhibit a lubricating function over a broad temperature range from the room temperature to about 473 K. Particularly, organoalkoxysilane, organosilazane and titanate coupling agent or fluorine-contained silicon silane coupling agents perform a surface treatment by chemical bonding of an organic compound on surfaces of iron-based and/or alloying powders through a condensation reaction of a hydroxyl group existing on the surfaces of the iron-based or alloying powders with the functional group *, wherein the functional group contains N or O combining with Si or Ti, in molecules of the surface treatment agents. Those surface treatment agents do not come off or flow out from the surfaces of the particles even at high temperature, and thus bring a remarkable effect of surface treatment at high temperature.

Organoalkoxysilane is ones having non-substitution or substitution of organic groups, which are expressed by structural formulas $R_nSi(OR')_{4-n}$ (n=1,2,3; R=organic group; R'=alkyl group) and

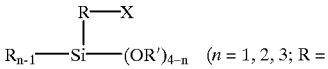

($n$ = 1, 2, 3; R = organic group; R'=alkyl group; X=substituent), respectively.

As the substituent (X) of substitution of the organic group, anyone of acrylic group, epoxy group and amino group is available. It is acceptable that these are used upon mixing of different types of ones. But, ones having an epoxy group and ones having an amino group are not suitable for a mixing, since they react on one another and undergo change of properties.

Organosilazane is a general term of compounds expressed by structural formulas $R_nSi(NH_2)_{4-1}$ (n=1,2,3), $(R_3Si)_2NH$, and $R_3Si—NH—Si—(R'_2SiNH)_n—Si—R''_3$ ($n \geqq 1$). While the organosilazane is not particularly restricted, polyorganosilazane expressed by the above-noted third structure formula is effective in improvement of the flowability.

Incidentally, it is preferable that the number of alkoxy groups (OR') of organoalkoxysilane is less. Of organoalkoxysilane having non-substitution of organic groups, methyl trimethoxy silane, phenyl trimethoxy silane and diphenyl methoxy silane are especially effective in improvement of the flowability. And of organoalkoxysilane having substitution of organic groups, as organoalkoxysilane of acrylic group in substituent, γ-methacryloxypropyl trimethoxy silane is especially effective in improvement of the flowability; as organoalkoxysilane of epoxy radical in substituent, γ-glycidoxypropyl trimethoxy silane; and as organoalkoxysilane of amino group insubstituent, γ-glycidoxypropyl trimethoxy silane and γ-aminopropyl trimethoxy silane. With regard to organoalkoxysilane having non-substitution or substitution of organic groups, there is available also ones in which part of hydrogen in an organic group R of the above-noted structure formulas is replaced by fluorine (it happens that organoalkoxysilane having organic group of replacement, in which part of hydrogen in an organic group R is replaced by fluorine, is classified as a fluorine-contained silicon silane coupling agent).

As titanate coupling agent, isopropyltriisostearoyl titanate is available.

The reasons why silicone oil and mineral oil are preferable for the surface treatment agent are as follows.

The reason why silicone oil and mineral oil are preferable for the surface treatment agent are that adsorption of those onto the surfaces of powders improves the flowability by decreasing the frictional resistance between particles, and in addition has a lubricating effect over a broad temperature range owing to the thermal stability.

As silicone oil available for the surface treatment agents, there are raised, for example, dimethyl silicone oil, methylphenyl silicone oil, methylhydrogen polysiloxane, polymethyl cyclo siloxane, alkyl-modified silicone oil, amino-modified silicone oil, silicone polyether copolymer, fatty acid-modified silicone oil, epoxy-modified silicone oil and fluorine-modified silicone oil. As mineral oil available for the surface treatment agents, there is raised, for example, alkylbenzene. It is noted that the surface treatment agents are not restricted to those compounds.

In iron powder mixtures having the stable flowability over the broad temperature range from the room temperature to about 473 K, it is preferable that organic compounds (a so-called binding agent and the like) for adhesion of iron-based and alloying powders are two or more types of wax each having mutually different melting point, especially, partial melts of amide lubricant. A method in which a melted-together compound composed of a fatty acid and a metallic soap is used, which is disclosed in Japanese Patent Application Laid Open Gazette (Kokai) Hei. 3-162502 by the present inventor, is optimum since melts coat the whole of additive particles by the capillarity so as to tightly adhere to the iron-based powder. Two or more types of wax each having mutually different melting points and partial melts of amide lubricant are preferable by the same reason.

The metallic soap to be used is melted with a low melting point, so that a flow rate at the higher temperature is increased. Consequently, it is desired that the melting point is not less than at least 423 K.

Next, there will be described the reasons why an ejection force at the time of compaction is reduced, so that the compactibility is improved, by means of mixing inorganic or organic compound having a layered crystal structure with iron-based and alloying powders.

With regard to the lubricating effect of compounds having a layered crystal structure, there are several theories. In case of the present invention, however, it is considered that the above-mentioned materials, which undergo the shearing stress at the time of compaction, are easy to be subjected to a cleavage along the crystal surface, and thus this causes reduction of frictional resistances among particles inside of the compact, or easy-to-sliding between the compact and die walls.

It is acceptable that the inorganic organic compound having-a layered crystal structure is anyone selected from among graphite, $MoS_2$, and carbon fluoride. The more fine size of particles is, the more effective for reduction of ejection force.

As the organic compound having a layered crystal structure, melamine-cyanuric acid adduct compound (MCA) or N-alkylasparatic acid-β-alkylester is available.

Next, there will be described the reasons why an ejection force at the time of compaction, particularly, at the time of warm compaction is reduced by means of mixing thermoplastic resin or thermoplastic elastomer with iron-based and alloying powders.

An aspect of the thermoplastic resin resides in the point that as the temperature rises the yield stress decreases, and as a result, it is easily deformed with the lower pressure. In a warm compaction in which a particle-like configuration of thermoplastic resin is mixed with iron-based and alloying powder and is heated for a compaction, particles of the thermoplastic resin will easily undergo plastic deformation between iron-based and/or alloying particles or between compacted particles and die walls, and as a result, frictional resistances between mutually contacted surfaces.

The thermoplastic elastomer implies a material having a multi-phase texture of the thermoplastic resin (hard phase) and the polymer having the rubber structure (soft phase). An aspect of the thermoplastic elastomer resides in the point that as the temperature rises the yield stress of the thermoplastic resin in soft phase decreases, and as a result, it is easily deformed with the lower pressure. Accordingly, the effect of the case in which a particle-like configuration of thermoplastic elastomer is mixed with iron-based and alloying powder and is subjected to a warm compaction process is the same as the above-mentioned thermoplastic resin.

As the thermoplastic resin, particles of polystyrene, nylon, polyethyrene or fluorine-contained resin are suitable.

As the thermoplastic elastomer, in the form of the soft phase, styrene resin, olefin resin, polyamide resin or silicone resin is suitable, and particularly, styrene-acryl and styrene-butadiene copolymers are suitable. The size of particles of the thermoplastic resin or elastomer is suitably 30 μm or less, and desirably 5 μm–20 μm. When the size of particles of the thermoplastic resin or elastomer is over 30 μm, it will prevent particles of the resin or elastomer from being sufficiently dispersed among metal particles. Thus, the lubricating effect cannot be expected.

As specific producing methods, embodiments will be exemplarily shown hereinafter.

EMBODIMENT 1

Various types of organoalkoxy diluted with silane, organosilazane and a coupling agent are melted in ethanol, and silicone oil and mineral oil were diluted with xylene. These were sprayed on iron powder for powder metallurgy having a mean particle diameter of 78 μm, or native graphite having a mean particle diameter of 23 μm or less, or copper powder having a mean particle diameter of 25 μm or less, by a suitable amount, and mixed up with a high speed mixer of 1000 rpm for one minute. Thereafter, solvents were removed by a vacuum dryer. One on which organoalkoxysilane, organosilazane and coupling agents are sprayed was heated for about one hour at about 373 K. This process is referred to as preliminary treatment A1. Table 1 shows types and loadings of surface treatment agents loaded in the preliminary treatment A1. The symbols set forth in the column of the surface treatment agents in Table 1 are the same as those shown in Table 14.

Iron powder for powder metallurgy having a mean particle diameter of 78 μm, which has undergone the preliminary treatment A1, or which has not undergone the preliminary treatment A1, native graphite having a mean particle diameter of 23 μm or less, which has undergone the preliminary treatment A1, or which has not undergone the preliminary treatment A1, and copper powder having a mean particle diameter of 25 μm or less, which has undergone the preliminary treatment A1, or which has not undergone the preliminary treatment A1, were mixed up with one another.

After this, 0.2% by weight stearamide and 0.2% by weight N,N'-Ethylenebis (stearamide) were added, and mixed and heated at 383 K. These were further mixed and cooled below 358 K.

On the other hand, 0.2% by weight stearamide stearate and 0.2% by weight zinc stearate were added and mixed up homogeneously, after which the mixture was discharged from a mixer. (Practical examples 1–11)

For a comparison, iron powder for powder metallurgy having a mean particle diameter of 78 μm, native graphite having a mean particle diameter of 23 μm or less, and copper powder having a mean particle diameter of 25 μm or less, which have not undergone the preliminary treatment A1, were used and mixed in a similar fashion to that of the above-mentioned embodiment 1, thereby obtaining the mixed powders (comparative example 1).

The mixed powders of 100 g thus obtained were discharged through an orifice having an emission hole of 5 mm in diameter, and a discharge time was measured at the room temperature. A result is shown in Table 1. As apparent from the comparison of comparative example 1 with practical examples 1–11, it will be understood that the flowability of the mixed powders has been dramatically improved in a case where the treatment is practiced with the surface treatment agents.

EMBODIMENT 2

Iron powder for powder metallurgy having a mean particle diameter of 78 μm, native graphite having a mean particle diameter of 23 μm or less, and copper powder having a mean particle diameter of 25 μm or less were mixed, and various types of organoalkoxysilane, organosilazane, a coupling agent, silicone oil or mineral oil were sprayed on the mixture by a suitable amount, and mixed up with a high speed mixer of 1000 rpm for one minute. Thereafter, 0.1% by weight oleic acid and 0.3% by weight zinc stearate were added, and mixed and heated at 383 K. After this, these were cooled below 358 K. The above-mentioned process such that "various types of organoalkoxysilane, organosilazane, a coupling agent, silicone oil or mineral oil were sprayed on the mixture by a suitable amount, and mixed up with a high speed mixer of 1000 rpm for one minute" is referred to as preliminary treatment B1. Table 2 shows types and loadings of surface treatment agents loaded in the preliminary treatment B1. The symbols set forth in the column of the surface treatment agents in Table 2 are the same as those shown in Table 14.

On the other hand, 0.4% by weight zinc stearate was added and mixed up homogeneously, after which the mixture was discharged from a mixer. (Practical examples 12–17)

For a comparison, iron powder for powder metallurgy having a mean particle diameter of 78 μm, native graphite having a mean particle diameter of 23 μm or less, and copper powder having a mean particle diameter of 25 μm or less were mixed, and further mixed in a similar fashion to that of the above-mentioned embodiment 2 without practicing the preliminary treatment B1, thereby obtaining the mixed powders (comparative example 2).

The mixed powders of 100 g thus obtained were discharged through an orifice having an emission hole of 5 mm in diameter, and a discharge time was measured at the room temperature. A result is shown in Table 2. As apparent from the comparison of comparative example 2 with practical examples 12–17, it will be understood that the flowability of the mixed powders has been dramatically improved in a case where the treatment is practiced with the surface treatment agents.

EMBODIMENT 3

0.2% by weight stearamide and 0.2% by weight N,N'-Ethylenebis (stearamide) were added to iron powder for powder metallurgy having a mean particle diameter of 78 μm, native graphite having a mean particle diameter of 23 μm or less, and copper powder having a mean particle diameter of 25 μm or less, and mixed and heated at 383 K. After this, further various types of organoalkoxysilane, organosilazane, a coupling agent, silicone oil or mineral oil were sprayed on the mixture by a suitable amount, and mixed up with a high speed mixer of 1000 rpm for one minute. Thereafter, these were cooled below 358 K. The process such that "further various types of organoalkoxysilane, organosilazane, a coupling agent, silicone oil or mineral oil were sprayed on the mixture by a suitable amount, and mixed up with a high speed mixer of 1000 rpm for one minute" is referred to as preliminary treatment C1. Table 3 shows types and loadings of surface treatment agents loaded in the preliminary treatment C1. The symbols set forth in the column of the surface treatment agents in Table 3 are the same as those shown in Table 14.

On the other hand, 0.2% by weight stearamide and 0.4% by weight zinc stearate were added and mixed up homogeneously, after which the mixture was discharged from a mixer. (Practical examples 18–22)

For a comparison, iron powder for powder metallurgy having a mean particle diameter of 78 μm, native graphite having a mean particle diameter of 23 μm or less, and copper powder having a mean particle diameter of 25 μm or less were used, and mixed in a similar fashion to that of the above-mentioned embodiment 3 without practicing the preliminary treatment C1, thereby obtaining the mixed powders (comparative example 3).

The mixed powders of 100 g thus obtained were discharged through an orifice having an emission hole of 5 mm in diameter, and a discharge time was measured at the room temperature. A result is shown in Table 3. As apparent from the comparison of comparative example 3 with practical examples 18–22, it will be understood that the flowability of the mixed powders has been dramatically improved in a case where the treatment is practiced with the surface treatment agents.

EMBODIMENT 4

Various types of organoalkoxysilane, organosilazane and a coupling agent are diluted with ethanol, and silicone oil and mineral oil were diluted with xylene. These were sprayed on partially alloyed steel powder for powder metallurgy having a mean particle diameter of 80 μm, or native graphite having a mean particle diameter of 23 μm, by a suitable amount, and mixed up with a high speed mixer of 1000 rpm for one minute. Thereafter, solvents were removed by a vacuum dryer. One on which organoalkoxysilane, organosilazane and a coupling agent are sprayed was heated for about one hour at about 373 K. This process is referred to as preliminary treatment A2. Tables 4-1 and 4-2 show types and loadings of surface treatment agents loaded in the preliminary treatment A2. The symbols set forth in the column of the surface treatment agents in Table 4 are the same as those shown in Table 14.

Partially alloyed steel powder for powder metallurgy having a mean particle diameter of 78 μm, which has undergone the preliminary treatment A2, or which has not undergone the preliminary treatment A2, and native graphite having a mean particle diameter of 23 μm or less, which has undergone the preliminary treatment A2, or which has not undergone the preliminary treatment A2, were mixed up with one another. After this, 0.1% by weight stearamide and 0.2% by weight ethylenebis (stearamide) and 0.1 % by weight lithium stearate were added, and mixed and heated at 433 K. These were further mixed and cooled below 358 K.

On the other hand, 0.4% by weight lithium stearate was added and mixed up homogeneously, after which the mixture was discharged from a mixer. (Practical examples 23–27)

For a comparison, alloyed steel powder for powder metallurgy having a mean particle diameter of 80 μm, and native graphite having a mean particle diameter of 23 μm or less, which have not undergone the preliminary treatment A2, were used and mixed in a similar fashion to that of the above-mentioned embodiment 4, thereby obtaining the mixed powders (comparative example 4).

The mixed powders of 100 g thus obtained were discharged through an orifice having an emission hole of 5 mm in diameter, and a discharge time was measured at the room temperature. A result is shown in Tables 4-1 and 4-2. As apparent from the comparison of comparative example 4 with practical examples 23–27, it will be understood that the flowability of the mixed powders has been dramatically improved in a case where the treatment is practiced with the surface treatment agents.

EMBODIMENT 5

Partially alloyed steel powder for powder metallurgy having a mean particle diameter of 80 μm, and native graphite having a mean particle diameter of 23 μm or less, were mixed, and various types of organoalkoxysilane, organosilazane, a coupling agent, silicone oil or mineral oil were sprayed on the mixture by a suitable amount, and mixed up with a high speed mixer of 1000 rpm for one minute. Thereafter, 0.2% by weight stearamide and 0.2% by weight ethylenebis (stearamide) were added, and mixed and heated at 433 K. After this, these were cooled below 358 K. The above-mentioned process such that "various types of organoalkoxysilane, organosilazane, a coupling agent, silicone oil or mineral oil were sprayed on the mixture by a suitable amount, and mixed up with a high speed mixer of 1000 rpm for one minute" is referred to as preliminary treatment B2. Tables 5-1 and 5-2 show types and amounts of surface treatment agents added in the preliminary treatment B2. The symbols set forth in the column of the surface treatment agents in Table 5 are the same as those shown in Table 14.

On the other hand, 0.4% by weight lithium hydroxy stearate was added and mixed up homogeneously, after which the mixture was discharged from a mixer. (Practical examples 28–31)

For a comparison, partially alloyed steel powder for powder metallurgy having a mean particle diameter of 80 μm, and native graphite having a mean particle diameter of 23 μm or less were mixed, and further mixed in a similar fashion to that of the above-mentioned embodiment 2 without practicing the preliminary treatment B2, thereby obtaining the mixed powders (comparative example 5).

The mixed powders of 100 g thus obtained were discharged through an orifice having an emission hole of 5 mm in diameter, and a discharge time was measured at the respective temperature from 293 K to 413 K. A result is shown in Tables 5-1 and 5-2. As apparent from the comparison of comparative example 5 with practical examples 28-31, it will be understood that the flowability of the mixed powders has been dramatically improved in a case where the treatment is practiced with the surface treatment agents.

EMBODIMENT 6

0.2% by weight stearamide and 0.2% by weight ethylenebis (stearamide) were added to the mixture of partially alloyed steel powder for powder metallurgy having a mean particle diameter of 80 μm, and native graphite having a mean particle diameter of 23 μm or less, and mixed and heated at 433 K. Thereafter, these were cooled to about 383 K. After this, various types of organoalkoxysilane, organosilazane, a coupling agent, silicone oil or mineral oil were sprayed on the mixture by a suitable amount, and mixed up with a high speed mixer of 1000 rpm for one minute. Thereafter, these were cooled below 358 K. This process is referred to as preliminary treatment C2. Table 6 shows types and loadings of surface treatment agent loaded in the preliminary treatment C2. The symbols set forth in the column of the surface treatment agents in Table 6 are the same as those shown in Table 14.

On the other hand, 0.4% by weight lithium hydroxy stearate was added and mixed up homogeneously, after which the mixture was discharged from a mixer. (Practical examples 32–34)

The mixed powders of 100 g thus obtained were discharged through an orifice having an emission hole of 5 mm in diameter, and a discharge time was measured at the room temperature. A result is shown in Table 6. As apparent from the comparison of comparative example 5 with practical examples 32–34, it will be understood that the flowability of the mixed powders has been dramatically improved in a case where the treatment is practiced with the surface treatment agents.

EMBODIMENT 7

Various types of organoalkoxysilane, organosilazane and a coupling agent are diluted with ethanol, and silicone oil and mineral oil were diluted with xylene. These were sprayed on partially alloyed steel powder for powder metallurgy having a mean particle diameter of 80 μm, or native graphite having a mean particle diameter of 23 μm or less, by a suitable amount, and mixed up with a high speed mixer of 1000 rpm for one minute. Thereafter, solvents were removed by a vacuum dryer. One on which organoalkoxysilane, organosilazane and a coupling agent are sprayed was heated for one hour at about 373 K. This process is referred to as preliminary treatment A2. Tables 7-1 and 7-2 show types and loadings of surface treatment agents loaded in the preliminary treatment A2. The symbols set forth in the column of the surface treatment agents in Table 7 are the same as those shown in Table 14.

Partially alloyed steel powder for powder metallurgy having a mean particle diameter of 80 μm, which has undergone the preliminary treatment A2, or which has not undergone the preliminary treatment A2, and native graphite having a mean particle diameter of 23 μm or less, which has undergone the preliminary treatment A2, or which has not undergone the preliminary treatment A2, were mixed up with one another. After this, 0.1% by weight stearamide, 0.2% by weight ethylenebis (stearamide) and 0.1% by weight of any one thermoplastic resin, thermoplastic elastomer and compounds having layered crystal structure were added, and mixed and heated at 433 K. These were further mixed and cooled below 358 K. In this case, names of the added materials and amounts are shown in tables 7-1 and 7-2. The symbols set forth in the column of the names of materials in Table 7 are the same as those shown in Table 15.

On the other hand, 0.2% by weight at least one type selected from among lithium stearate, lithium hydroxy stearate and calcium laurate was added and mixed up homogeneously, after which the mixture was discharged from a mixer (Practical examples 35–39). In this case, names of the added materials and amounts are shown in tables 14 and 15.

The mixed powders of 100 g thus obtained were discharged through an orifice having an emission hole of 5 mm in diameter, and a discharge time was measured at the respective temperatures from 293 K to 413 K. Further, the mixed powders were heated to 423 K to form a tablet having 11 mm in diameter with pressure of 686 MPa, and ejection force and green compact density at the time of compaction were measured. A result is shown in Tables 7-1 and 7-2. As apparent from the comparison of comparative example 6 with practical examples 35–39, it will be understood that the flowability of the mixed powders at the respective temperatures has been dramatically improved in a case where the treatment is practiced with the surface treatment agents.

Further, as apparent from the comparison of comparative example 6 with practical examples 35–39, it will be understood that the green compact density is improved, and the ejection force is decreased, so that the compactibility has been improved in a case where thermoplastic resin, thermoplastic elastomer or compound having layered crystal structure is added and in addition the treatment is practiced with the surface treatment agents.

EMBODIMENT 8

Partially alloyed steel powder for powder metallurgy having a mean particle diameter of 80 μm, and native graphite having a mean particle diameter of 23 μm or less, were mixed, and various types of organoalkoxysilane, organosilazane, a coupling agent, silicone oil or mineral oil were sprayed on the mixture by a suitable amount, and mixed up with a high speed mixer of 1000 rpm for one minute. Thereafter, 0.2% by weight stearamide, 0.2% by weight. ethylenebis (stearamide) and 0.1% by weight anyone of thermoplastic resin, thermoplastic elastomer and compounds having layered crystal structure were added, and mixed and heated at 433 K. After this, these were further mixed and cooled below 358 K. The above-mentioned process such that "various types of organoalkoxysilane, organosilazane, a coupling agent, silicone oil or mineral oil were sprayed on the mixture by a suitable amount, and mixed up with a high speed mixer of 1000 rpm for one minute" is referred to as preliminary treatment B2. Tables 8-1 and 8-2 show types and loadings of surface treatment agents loaded in the preliminary treatment B2, and thermoplastic resin, thermoplastic elastomer or compounds having layered crystal structure. The symbols set forth in the column of the surface treatment agents in Table 8 are the same as those shown in Table 14. The symbols set forth in the column of thermoplastic resin, thermoplastic elastomer or compounds having layered crystal structure in Table 8 are the same as those shown in Table 15.

On the other hand, 0.2% by weight at least one type selected from among lithium stearate, lithium hydroxy stearate and calcium laurate was added and mixed up homogeneously, after which the mixture was discharged from a mixer (Practical examples 40–43). In this case, names of the added materials and amounts are shown in tables 14 and 15.

The mixed powders of 100 g thus obtained were discharged through an orifice having an emission hole of 5 mm in diameter, and a discharge time was measured at the respective temperatures from 293 K to 413 K. Further, the mixed powders were heated to 150° C. to form a tablet having 11 mm in diameter with pressure of 686 MPa, and ejection force and green compact density at the time of compaction were measured. A result is shown in Table 8. As apparent from the comparison of comparative example 6 with practical examples 40–43, it will be understood that the flowability of the mixed powders at the respective temperatures has been dramatically improved in a case where the treatment is practiced with the surface treatment agents.

Further, as apparent from the comparison of comparative example 6 with practical examples 40–43, it will be understood that the green compact density is improved, and the ejection force is decreased, so that the compactibility has been improved in a case where thermoplastic resin, thermoplastic elastomer or compound having layered crystal structure is added and in addition the treatment is practiced with the surface treatment agents.

EMBODIMENT 9

0.2% by weight stearamide, 0.2% by weight ethylenebis (stearamide) and 0.1% by weight anyone of thermoplastic resin, thermoplastic elastomer and compounds having layered crystal structure were added to the mixture of partially alloyed steel powder for powder metallurgy having a mean particle diameter of 80 μm, and native graphite having a mean particle diameter of 23 μm or less, and mixed and heated at 433 K. Thereafter these were cooled to about 383 K. After this, various types of organoalkoxysilane, organosilazane, a coupling agent, silicone oil or mineral oil were sprayed on the mixture by a suitable amount, and mixed up with a high speed mixer of 1000 rpm for one minute. Thereafter, these were cooled below 358 K. The above-mentioned process such that "various types of organoalkoxysilane, organosilazane, a coupling agent, silicone oil or mineral oil were sprayed on the mixture by a suitable amount, and mixed up with a high speed mixer of 1000 rpm for one minute" is referred to as preliminary treatment C2. Tables 9-1 and 9-2 show types and loadings of surface treatment agents loaded in the preliminary treatment C2, and thermoplastic resin, thermoplastic elastomer or compounds having layered crystal structure. The symbols set forth in the column of the surface treatment agents in Table 9 are the same as those shown in Table 14. The symbols set forth in the column of thermoplastic resin, thermoplastic elastomer or compounds having layered crystal structure in Table 9 are the same as those shown in Table 15 and its footnotes.

On the other hand, 0.4% by weight lithium hydroxy stearate was added and mixed up homogeneously, after which the mixture was discharged from a mixer. (Practical examples 44–48).

The mixed powders of 100 g thus obtained were discharged through an orifice having an emission hole of 5 mm in diameter, and a discharge time was measured at the respective temperatures from 293 K to 413 K. Further, the mixed powders were heated to 423 K to form a tablet having 11 mm in diameter with pressure of 686 MPa, and ejection force and green compact density at the time of compaction were measured. A result is shown in Tables 9-1 and 9-2. As apparent from the comparison of comparative example 6 with practical examples 44–48, it will be understood that the flowability of the mixed powders at the respective temperatures has been dramatically improved in a case where the treatment is practiced with the surface treatment agents.

Further, as apparent from the comparison of comparative example 6 with practical examples 44–48, it will be understood that the green compact density is improved, and the ejection force is decreased, so that the compactibility has been improved in a case where thermoplastic resin, thermoplastic elastomer or compound having layered crystal structure is added and in addition the treatment is practiced with the surface treatment agents.

EMBODIMENT 10

Various types of organoalkoxysilane, organosilazane silane and coupling agent are diluted with ethanol, and silicone oil and mineral oil were diluted with xylene. These were sprayed on partially alloyed steel powder for powder metallurgy having a mean particle diameter of 80 μm, or native graphite having a mean particle diameter of 23 μm or less, by a suitable amount, and mixed up with a high speed mixer of 1000 rpm for one minute. Thereafter, solvents were removed by a vacuum dryer. One on which organoalkoxysilane, organosilazane and a coupling agent are sprayed was heated for one hour at about 373 K. This process is referred to as preliminary treatment A2. Tables 10-1 and 10-2 show types and amounts of surface treatment agents loaded in the preliminary treatment A2. The symbols set forth in the column of the surface treatment agents in Table 10 are the same as those shown in Table 14.

Partially alloyed steel powder for powder metallurgy having a mean particle diameter of 80 μm, which has undergone the preliminary treatment A2, or which has not undergone the preliminary treatment A2, and native graphite having a mean particle diameter of 23 μm or less, which has undergone the preliminary treatment A2, or which has not undergone the preliminary treatment A2, were mixed up with one another. After this, 0.1% by weight stearamide, 0.2% by weight ethylenebis (stearamide) and 0.1% by weight anyone of thermoplastic resin, thermoplastic elastomer and compounds having layered crystal structure were added, and mixed and heated at 433 K. These were further mixed and cooled below 358 K. In this case, types and amounts of the loaded thermoplastic resin, thermoplastic elastomer or compounds having layered crystal structure are shown in tables 10-1 and 10-2. The symbols set forth in the column of thermoplastic resin, thermoplastic elastomer or compounds having layered crystal structure shown in table 10 are the same as those shown in Table 15.

On the other hand, 0.2% by weight of at least one type selected from among lithium stearate, lithium hydroxy stearate and calcium laurate was added and mixed up homogeneously, after which the mixture was discharged from a mixer (Practical examples 49–52). In this case, names of the loaded materials and loadings are shown in tables 14 and 15.

The mixed powders of 100 g thus obtained were discharged through an orifice having an emission hole of 5 mm in diameter, and a discharge time was measured at the respective temperatures from 293 K to 413 K. Further, the mixed powders were heated to 423 K to form a tablet having 11 mm in diameter with pressure of 686 MPa, and ejection force and green compact density at the time of compaction were measured. A result is shown in Tables 10-1 and 10-2. As apparent from the comparison of comparative example 6 with practical examples 49–50, it will be understood that the flowability of the mixed powders at the respective temperatures has been dramatically improved in a case where the treatment is practiced with the surface treatment agents.

Further, as apparent from the comparison of comparative example 6 with practical examples 49–52, it will be understood that the green compact density is improved, and the ejection force is decreased, so that the compactibility has been improved in a case where thermoplastic resin, thermoplastic elastomer or compound having layered crystal structure is added and in addition the treatment is practiced with the surface treatment agents.

EMBODIMENT 11

Partially alloyed steel powder for powder metallurgy having a mean particle diameter of 80 μm, and native graphite having a mean particle diameter of 23 μm or less, were mixed, and various types of organoalkoxysilane, organosilazane, a coupling agent, silicone oil or mineral oil were sprayed on the mixture by a suitable amount, and mixed up with a high speed mixer of 1000 rpm for one minute. Thereafter, 0.2% by weight stearamide and 0.2% by weight ethylenebis (stearamide) were added, and mixed and heated at 433 K. After this, these were further mixed and cooled to 85° C. (358 K). The above-mentioned process such that "various types of organoalkoxysilane, organosilazane, a coupling a gent, silicone oil or mineral oil were sprayed on the mixture by a suitable amount, and mixed up with a high speed mixer of 1000 rpm for one minute" is referred to as preliminary treatment B2. Tables 11-1 and 11-2 show types and loadings of surface treatment agents loaded in the preliminary treatment B2. The symbols set forth in the column of the surface treatment agents in Table 11 are the same as those shown in Table 14.

On the other hand, 0.1% by weight lithium stearate and 0.2% by weight at least one type of thermoplastic resin, thermoplastic elastomer and compounds having layered crystal structure were added and mixed up homogeneously, after which the mixture was discharged from a mixer (Practical examples 53–56). In this case, names of the added materials and amounts are shown in tables 11-1 and 11-2. The symbols set forth in the column of thermoplastic resin, thermoplastic elastomer or compounds having layered crystal structure shown in table 10 are the same as those shown in Table 15.

The mixed powders of 100 g thus obtained were discharged through an orifice having an emission hole of 5 mm in diameter, and a discharge time was measured at the respective temperatures from 293 K to 413 K. Further, the mixed powders were heated to 423 K to form a tablet having 11 mm in diameter with pressure of 686 MPa, and ejection force and green compact density at the time of compaction were measured. A result is shown in Tables 11-1 and 11-2. As apparent from the comparison of comparative example 6 with practical examples 53–56, it will be understood that the flowability of the mixed powders at the respective temperatures has been dramatically improved in a case where the treatment is practiced with the surface treatment agents.

Further, as apparent from the comparison of comparative example 6 with practical examples 53–56, it will be understood that the green compact density is improved, and the ejection force is decreased, so that the compactibility has been improved in a case where thermoplastic resin, thermoplastic elastomer or compound having layered crystal structure is added and in addition the treatment is practiced with the surface treatment agents.

EMBODIMENT 12

0.2% by weight stearamide and 0.2% by weight ethylenebis (stearamide) were added to the mixture of partially alloyed steel powder for powder metallurgy having a mean particle diameter of 80 μm, and native graphite having a mean particle diameter of 23 μm or less, and mixed and heated at 433 K. Thereafter these were cooled to about 383 K. After this, various types of organoalkoxysilane, organosilazane, a coupling agent, silicone oil or mineral oil were sprayed on the mixture by a suitable amount, and mixed up with a high speed mixer of 1000 rpm for one minute. Thereafter, these were cooled below 358 K. The above-mentioned process such that "various types of organoalkoxysilane, organosilazane, a coupling agent, silicone oil or mineral oil were sprayed on the mixture by a suitable amount, and mixed up with a high speed mixer of 1000 rpm for one minute" is referred to as preliminary treatment C2. Table 12 shows types and amounts of surface treatment agents added in the preliminary treatment C2. The symbols set forth in the column of the surface treatment agents in Table 12 are the same as those shown in Table 14.

On the other hand, 0.1% by weight lithium stearate and 0.2% by weight at least one type of thermoplastic resin, thermoplastic elastomer and compounds having layered crystal structure were added and mixed up homogeneously, after which the mixture was discharged from a mixer (Practical examples 57–59). In this case, names of the added materials and amounts are shown in table 12. The symbols set forth in the column of thermoplastic resin, thermoplastic elastomer or compounds having layered crystal structure shown in table 12 are the same as those shown in Table 15.

The mixed powders of 100 g thus obtained were discharged through an orifice having an emission hole of 5 mm in diameter, and a discharge time was measured at the respective temperatures from 293 K to 413 K. Further, the mixed powders were heated to 423 K to form a tablet having 11 mm in diameter with pressure of 686 MPa, and ejection force and green compact density at the time of compaction were measured. A result is shown in Table 12. As apparent from the comparison of comparative example 6 with practical examples 57–59, it will be understood that the flowability of the mixed powders at the respective temperatures has been dramatically improved in a case where the treatment is practiced with the surface treatment agents.

Further, as apparent from the comparison of comparative example 6 with practical examples 57–59, it will be understood that the green compact density is improved, and the ejection force is decreased, so that the compactibility has been improved in a case where thermoplastic resin, thermoplastic elastomer or compound having layered crystal structure is added and in addition the treatment is practiced with the surface treatment agents.

EMBODIMENT 13

0.2% by weight stearamide and 0.2% by weight ethylenebis (stearamide) were added to the mixture of partially alloyed steel powder for powder metallurgy having a mean particle diameter of 80 μm, and native graphite having a mean particle diameter of 23 μm or less, and mixed and heated at 433 K. Thereafter these were cooled to about 383 K. After this, various types of organoalkoxysilane, organosilazane, a coupling agent, silicone oil or mineral oil were sprayed on the mixture by a suitable amount, and mixed up with a high speed mixer of 1000 rpm for one minute. Thereafter, these were cooled below 358 K. The above-mentioned process such that "various types of organoalkoxysilane, organosilazane, a coupling agent, silicone oil or mineral oil were sprayed on the mixture by a suitable amount, and mixed up with a high speed mixer of 1000 rpm for one minute" is referred to as preliminary treatment C2. Tables 13-1 and 13-2 show types and loadings of surface treatment agents loaded in the preliminary treatment C2, and thermoplastic resin, thermoplastic elastomer or compounds having layered crystal structure. The symbols set forth in the column of the surface treatment agents in Table 13 are the same as those shown in Table 14.

On the other hand, 0.1% by weight lithium stearate and 0.2% by weight at least one type of thermoplastic resin, thermoplastic elastomer and compounds having layered crystal structure were added and mixed up homogeneously, after which the mixture was discharged from a mixer (Practical examples 60–63). In this case, names of the added materials and amounts are shown in tables 13-1 and 13-2. The symbols set forth in the column of thermoplastic resin, thermoplastic elastomer or compounds having layered crystal structure shown in table 13 are the same as those shown in Table 15.

The mixed powders of 100 g thus obtained were discharged through an orifice having an emission hole of 5 mm in diameter, and a discharge time was measured at the respective temperatures from 293 K to 413 K. Further, the mixed powders were heated to 423 K to form a tablet having 11 mm in diameter with pressure of 686 MPa, and ejection force and green compact density at the time of compaction were measured. A result is shown in Tables 13-1 and 13-2. As apparent from the comparison of comparative example 6 with practical examples 60–63, it will be understood that the flowability of the mixed powders at the respective temperatures has been dramatically improved in a case where the treatment is practiced with the surface treatment agents.

Further, as apparent from the comparison of comparative example 6 with practical examples 60–63, it will be understood that the green compact density is improved, and the ejection force is decreased, so that the compactibility has been improved in a case where thermoplastic resin, thermoplastic elastomer or compound having layered crystal structure is added and in addition the treatment is practiced with the surface treatment agents.

TABLE 1

| | Iron Powder (IP) (g) | Surface treatment agents (wt % to IP) | Copper Powder (CP) (g) | Surface treatment agents (wt % to CP) | Graphite (GP) (g) | Surface treatment agents (wt % to GP) | Flow rate (sec/100 g) |
|---|---|---|---|---|---|---|---|
| Prac. Ex. 1 | 1000 | a (0.02) | 40 | | 8 | | 12.8 |
| Prac. Ex. 2 | 1000 | b (0.02) | 40 | | 8 | | 12.9 |
| Prac. Ex. 3 | 1000 | c (0.02) | 40 | | 8 | | 13.6 |
| Prac. Ex. 4 | 1000 | d (0.02) | 40 | | 8 | | 13.3 |
| Prac. Ex. 5 | 1000 | | 40 | e (0.5) | 8 | | 14.5 |
| Prac. Ex. 6 | 1000 | f (0.02) | 40 | a (0.5) | 8 | | 12.4 |
| Prac. Ex. 7 | 1000 | j (0.01) | 40 | | 8 | | 14.3 |
| Prac. Ex. 8 | 1000 | | 40 | | 8 | c (0.4) | 14.2 |
| Prac. Ex. 9 | 1000 | e (0.02) | 40 | | 8 | c (0.4) | 13.5 |

TABLE 1-continued

| | Iron Powder (IP) (g) | Surface treatment agents (wt % to IP) | Copper Powder (CP) (g) | Surface treatment agents (wt % to CP) | Graphite (GP) (g) | Surface treatment agents (wt % to GP) | Flow rate (sec/100 g) |
|---|---|---|---|---|---|---|---|
| Prac. Ex. 10 | 1000 | f (0.02) | 40 | a (0.5) | 8 | d (0.4) | 12.7 |
| Prac. Ex. 11 | 1000 | f (0.02) | 40 | l (0.5) | 8 | | 14.1 |
| Comp. Ex. 1 | 1000 | | 40 | | 8 | | 15.1 |

TABLE 2

| | Iron Powder (IP) (g) | Copper Powder (g) | Graphite (g) | Surface treatment agents (wt % to IP) | Flow rate (sec/100 g) |
|---|---|---|---|---|---|
| Prac. Ex. 12 | 1000 | 20 | 6 | c (0.04) | 12.7 |
| Prac. Ex. 13 | 1000 | 20 | 6 | e (0.02) | 12.6 |
| Prac. Ex. 14 | 1000 | 20 | 6 | g (0.03) | 13.5 |
| Prac. Ex. 15 | 1000 | 20 | 6 | h (0.02) | 13.7 |
| Prac. Ex. 16 | 1000 | 20 | 6 | j (0.01) | 14.0 |
| Prac. Ex. 17 | 1000 | 20 | 6 | k (0.01) | 14.2 |
| Comp. Ex. 2 | 1000 | 20 | 6 | | 14.7 |

TABLE 3

| | Iron Powder (IP) (g) | Copper Powder (g) | Graphite (g) | Surface treatment agents (wt % to IP) | Flow rate (sec/100 g) |
|---|---|---|---|---|---|
| Prac. Ex. 18 | 1000 | 20 | 8 | c (0.03) | 13.3 |
| Prac. Ex. 19 | 1000 | 20 | 8 | e (0.02) | 13.4 |
| Prac. Ex. 20 | 1000 | 20 | 8 | f (0.02) | 13.1 |
| Prac. Ex. 21 | 1000 | 20 | 8 | i (0.02) | 13.5 |
| Prac. Ex. 22 | 1000 | 20 | 8 | k (0.01) | 13.3 |
| Comp. Ex. 3 | 1000 | 20 | 8 | | 14.5 |

TABLE 4-1

| | Partially alloyed steel powder (SP) (g) | Surface treatment agents (wt % to SP) | Graphite (GP) (g) | Surface treatment agents (wt % to GP) | Measuring temperature (K.) | Flow rate (sec/100 g) |
|---|---|---|---|---|---|---|
| Prac. Ex. 23 | 1000 | a (0.02) | 5 | | 293 | 11.7 |
| | | | | | 323 | 11.7 |
| | | | | | 353 | 11.8 |
| | | | | | 373 | 11.9 |
| | | | | | 393 | 12.0 |
| | | | | | 413 | 12.1 |
| Prac. Ex. 24 | 1000 | c (0.02) | 5 | d (0.5) | 293 | 11.6 |
| | | | | | 323 | 11.5 |
| | | | | | 353 | 11.6 |
| | | | | | 373 | 11.8 |
| | | | | | 393 | 11.9 |
| | | | | | 413 | 12.0 |
| Prac. Ex. 25 | 1000 | h (0.02) | 5 | | 293 | 11.8 |
| | | | | | 323 | 11.8 |
| | | | | | 353 | 11.9 |
| | | | | | 373 | 12.0 |
| | | | | | 393 | 12.1 |
| | | | | | 413 | 12.2 |

TABLE 4-2

| | Partially alloyed steel powder (SP) (g) | Surface treatment agents (wt % to SP) | Graphite (GP) (g) | Surface treatment agents (wt % to GP) | Measuring temperature (K.) | Flow rate (sec/100 g) |
|---|---|---|---|---|---|---|
| Prac. Ex. 26 | 1000 | m (0.01) | 5 | f (0.5) | 293 | 11.1 |
| | | | | | 323 | 11.3 |
| | | | | | 353 | 11.2 |
| | | | | | 373 | 11.8 |
| | | | | | 393 | 11.9 |
| | | | | | 413 | 12.1 |

TABLE 4-2-continued

| | Partially alloyed steel powder (SP) (g) | Surface treatment agents (wt % to SP) | Graphite (GP) (g) | Surface treatment agents (wt % to GP) | Measuring temperature (K.) | Flow rate (sec/100 g) |
|---|---|---|---|---|---|---|
| Prac. Ex. 27 | 1000 | | 5 | g (0.5) | 293 | 11.5 |
| | | | | | 323 | 11.6 |
| | | | | | 353 | 11.8 |
| | | | | | 373 | 11.9 |
| | | | | | 393 | 12.0 |
| | | | | | 413 | 12.7 |
| Comp.Ex. 4 | 1000 | | 5 | | 293 | 12.5 |
| | | | | | 323 | 12.5 |
| | | | | | 353 | 12.8 |
| | | | | | 373 | 12.9 |
| | | | | | 393 | 13.1 |
| | | | | | 413 | 13.5 |

TABLE 5-1

| | Partially alloyed steel powder (SP) (g) | Graphite (g) | Surface treatment agents (wt % to SP) | Measuring temperature (K.) | Flow rate (sec/100 g) |
|---|---|---|---|---|---|
| Prac. Ex. 28 | 1000 | 6 | c (0.03) | 293 | 11.2 |
| | | | | 323 | 11.3 |
| | | | | 353 | 11.3 |
| | | | | 373 | 11.5 |
| | | | | 393 | 11.6 |
| | | | | 413 | 11.7 |
| Prac. Ex. 29 | 1000 | 6 | f (0.03) | 293 | 11.0 |
| | | | | 323 | 11.0 |
| | | | | 353 | 11.2 |
| | | | | 373 | 11.3 |
| | | | | 393 | 11.5 |
| | | | | 413 | 11.5 |
| Prac. Ex. 30 | 1000 | 6 | h (0.04) | 293 | 11.5 |
| | | | | 323 | 11.7 |
| | | | | 353 | 11.7 |
| | | | | 373 | 11.8 |
| | | | | 393 | 11.9 |
| | | | | 413 | 12.0 |

TABLE 5-2

| | Partially alloyed steel powder (SP) (g) | Graphite (g) | Surface treatment agents (wt % to SP) | Measuring temperature (K.) | Flow rate (sec/100 g) |
|---|---|---|---|---|---|
| Prac. Ex. 31 | 1000 | 6 | j (0.01) | 293 | 11.8 |
| | | | | 323 | 11.8 |
| | | | | 353 | 12.0 |
| | | | | 373 | 12.2 |
| | | | | 393 | 12.1 |
| | | | | 413 | 12.5 |
| Comp. Ex. 5 | 1000 | 6 | | 293 | 12.7 |
| | | | | 323 | 12.8 |
| | | | | 353 | 12.8 |
| | | | | 373 | 13.0 |
| | | | | 393 | 13.2 |
| | | | | 413 | 14.5 |

TABLE 6

| | Partially alloyed steel powder (SP) (g) | Graphite (g) | Surface treatment agents (wt % to SP) | Measuring temperature (K.) | Flow rate (sec/100 g) |
|---|---|---|---|---|---|
| Prac. Ex. 32 | 1000 | 6 | b (0.03) | 293 | 11.5 |
| | | | | 323 | 11.5 |
| | | | | 353 | 11.6 |

TABLE 6-continued

| | Partially alloyed steel powder (SP) (g) | Graphite (g) | Surface treatment agents (wt % to SP) | Measuring temperature (K.) | Flow rate (sec/100 g) |
|---|---|---|---|---|---|
| | | | | 373 | 11.7 |
| | | | | 393 | 11.8 |
| | | | | 413 | 12.0 |
| Prac. Ex. 33 | 1000 | 6 | g (0.04) | 293 | 11.4 |
| | | | | 323 | 11.5 |
| | | | | 353 | 11.5 |
| | | | | 373 | 11.7 |
| | | | | 393 | 11.8 |
| | | | | 413 | 12.3 |
| Prac. Ex. 34 | 1000 | 6 | j (0.01) | 293 | 11.8 |
| | | | | 323 | 11.9 |
| | | | | 353 | 12.0 |
| | | | | 373 | 12.1 |
| | | | | 393 | 12.5 |
| | | | | 413 | 13.1 |

20

TABLE 7-1

| | Partially alloyed steel powder (SP) (g) | Surface treatment agents (wt % to SP) | Graphite (GP) (g) | Surface treatment agents (wt % to GP) | Thermoplastic resin, thermoplastic elastomer or compounds having layered crystal structure (wt % to SP) | Measuring temperature (K.) | Flow rate (sec/100 g) | Compactibility 423 K, 686 MPa Green density ($Mg/m^3$) | Ejection force (MPa) |
|---|---|---|---|---|---|---|---|---|---|
| Prac. Ex. 35 | 1000 | f (0.02) | 6 | | i (0.1) | 293 | 11.8 | 7.30 | 29.0 |
| | | | | | | 323 | 11.9 | | |
| | | | | | | 353 | 11.9 | | |
| | | | | | | 373 | 12.1 | | |
| | | | | | | 393 | 12.3 | | |
| | | | | | | 413 | 12.5 | | |
| Prac. Ex. 36 | 1000 | h (0.02) | 6 | f (0.5) | iV (0.1) | 293 | 11.7 | 7.33 | 28.7 |
| | | | | | | 323 | 11.7 | | |
| | | | | | | 353 | 11.8 | | |
| | | | | | | 373 | 11.9 | | |
| | | | | | | 393 | 12.0 | | |
| | | | | | | 413 | 12.7 | | |
| Prac. Ex. 37 | 1000 | g (0.02) | 6 | | Vii (0.1) | 293 | 11.8 | 7.31 | 26.7 |
| | | | | | | 323 | 11.8 | | |
| | | | | | | 353 | 11.9 | | |
| | | | | | | 373 | 12.1 | | |
| | | | | | | 393 | 12.5 | | |
| | | | | | | 413 | 13.0 | | |

TABLE 7-2

| | Partially alloyed steel powder (SP) (g) | Surface treatment agents (wt % to SP) | Graphite (GP) (g) | Surface treatment agents (wt % to GP) | Thermoplastic resin, elastomer or compounds having layered crystal structure (wt % to SP) | thermoplastic Measuring temperature (K.) | Flow rate (sec/100 g) | Compactibility 423 K, 686 MPa Green density ($Mg/m^3$) | Ejection force (MPa) |
|---|---|---|---|---|---|---|---|---|---|
| Prac. Ex. 38 | 1000 | c (0.02) | 6 | | xiii (0.1) | 293 | 11.9 | 7.32 | 31.2 |
| | | | | | | 323 | 11.9 | | |
| | | | | | | 353 | 12.0 | | |
| | | | | | | 373 | 12.1 | | |
| | | | | | | 393 | 12.3 | | |
| | | | | | | 413 | 12.5 | | |
| Prac. Ex. 39 | 1000 | i (0.02) | 6 | | ix (0.1) | 293 | 11.8 | 7.33 | 33.5 |
| | | | | | | 323 | 11.7 | | |
| | | | | | | 353 | 11.9 | | |
| | | | | | | 373 | 12.0 | | |

TABLE 7-2-continued

| | Partially alloyed steel powder (SP) (g) | Surface treatment agents (wt % to SP) | Graphite (GP) (g) | Surface treatment agents (wt % to GP) | Thermoplastic resin, elastomer or compounds having layered crystal structure (wt % to SP) | thermoplastic Measuring temperature (K.) | thermoplastic Flow rate (sec/100 g) | Compactibility 423 K, 686 MPa Green density ($Mg/m^3$) | Compactibility 423 K, 686 MPa Ejection force (MPa) |
|---|---|---|---|---|---|---|---|---|---|
| | | | | | | 393 | 12.2 | | |
| | | | | | | 413 | 12.3 | | |
| Comp. Ex. 6 | 1000 | | 6 | | | 293 | 12.7 | 7.28 | 40.2 |
| | | | | | | 323 | 12.7 | | |
| | | | | | | 353 | 12.8 | | |
| | | | | | | 373 | 12.9 | | |
| | | | | | | 393 | 13.5 | | |
| | | | | | | 413 | 14.8 | | |

TABLE 8-1

| | Partially alloyed steel powder (SP) (g) | Graphite (g) | Surface treatment agents (wt % to SP) | Thermoplastic resin, thermoplastic elastomer or compounds having layered crystal structure (wt % to SP) | Measuring temperature (K.) | Flow rate (sec/100 g) | Compactibility 423 K, 686 MPa Green density ($Mg/m^3$) | Compactibility 423 K, 686 MPa Ejection force (MPa) |
|---|---|---|---|---|---|---|---|---|
| Prac. Ex. 40 | 1000 | 6 | a (0.02) | ii (0.1) | 293 | 11.9 | 7.31 | 22.5 |
| | | | | | 323 | 11.7 | | |
| | | | | | 353 | 11.8 | | |
| | | | | | 373 | 11.9 | | |
| | | | | | 393 | 12.0 | | |
| | | | | | 413 | 12.5 | | |
| Prac. Ex. 41 | 1000 | 6 | d (0.03) | v (0.1) | 293 | 11.8 | 7.31 | 24.0 |
| | | | | | 323 | 11.8 | | |
| | | | | | 353 | 11.9 | | |
| | | | | | 373 | 12.0 | | |
| | | | | | 393 | 12.2 | | |
| | | | | | 413 | 12.7 | | |
| Prac. Ex. 42 | 1000 | 6 | h (0.02) | viii (0.1) | 293 | 12.1 | 7.30 | 26.3 |
| | | | | | 323 | 12.0 | | |
| | | | | | 353 | 12.1 | | |
| | | | | | 373 | 12.3 | | |
| | | | | | 393 | 12.5 | | |
| | | | | | 413 | 12.8 | | |

TABLE 8-2

| | Partially alloyed steel powder (SP) (g) | Graphite (GP) (g) | Surface treatment agents (wt % to SP) | Thermoplastic resin, thermoplastic elastomer or compounds having layered crystal structure (wt % to SP) | Measuring temperature (K.) | Flow rate (sec/100 g) | Compactibility 423 K, 686 MPa Green density ($Mg/m^3$) | Compactibility 423 K, 686 MPa Ejection force (MPa) |
|---|---|---|---|---|---|---|---|---|
| Prac. Ex. 43 | 1000 | 6 | g (0.04) | xii (0.1) | 293 | 11.9 | 7.34 | 33.8 |
| | | | | | 323 | 12.0 | | |
| | | | | | 353 | 12.0 | | |
| | | | | | 373 | 12.1 | | |
| | | | | | 393 | 12.5 | | |

TABLE 9-1

| | Partially alloyed steel powder (SP) (g) | Graphite (GP) (g) | Surface treatment agents (wt % to SP) | Thermoplastic resin, thermoplastic elastomer or compounds having layered crystal structure (wt % to SP) | Measuring temperature (K.) | Flow rate (sec/100 g) | Compactibility 423 K, 686 MPa Green density ($Mg/m^3$) | Ejection force (MPa) |
|---|---|---|---|---|---|---|---|---|
| Prac. Ex. 44 | 1000 | 6 | c (0.02) | iii (0.1) | 293 | 11.8 | 7.32 | 26.0 |
| | | | | | 323 | 11.9 | | |
| | | | | | 353 | 11.9 | | |
| | | | | | 373 | 12.0 | | |
| | | | | | 393 | 12.1 | | |
| | | | | | 413 | 12.7 | | |
| Prac. Ex. 45 | 1000 | 6 | m (0.01) | v (0.1) | 293 | 12.0 | 7.33 | 24.1 |
| | | | | | 323 | 12.1 | | |
| | | | | | 353 | 12.1 | | |
| | | | | | 393 | 12.5 | | |
| | | | | | 413 | 13.1 | | |
| Prac. Ex. 46 | 1000 | 6 | e (0.02) | viii (0.1) | 293 | 12.1 | 7.30 | 27.0 |
| | | | | | 323 | 12.1 | | |
| | | | | | 353 | 12.2 | | |
| | | | | | 373 | 12.5 | | |
| | | | | | 393 | 12.7 | | |
| | | | | | 413 | 13.3 | | |

TABLE 9-2

| | Partially alloyed steel powder (SP) (g) | Graphite (g) | Surface treatment agents (wt % to SP) | Thermoplastic resin, thermoplastic elastomer or compounds having layered crystal structure (wt % to SP) | Measuring temperature (K.) | Flow rate (sec/100 g) | Compactibility 423 K, 686 MPa Green density ($Mg/m^3$) | Ejection force (MPa) |
|---|---|---|---|---|---|---|---|---|
| Prac. Ex. 47 | 1000 | 6 | g (0.02) | i (0.05) | 293 | 12.0 | 7.31 | 23.5 |
| | | | | xiii (0.05) | 323 | 11.9 | | |
| | | | | | 353 | 12.0 | | |
| | | | | | 373 | 12.1 | | |
| | | | | | 393 | 12.3 | | |
| | | | | | 413 | 12.7 | | |
| Prac. Ex. 48 | 1000 | 6 | f (0.02) | iii (0.01) | 293 | 12.1 | 7.32 | 25.1 |
| | | | | | 323 | 12.1 | | |
| | | | | | 353 | 12.1 | | |
| | | | | | 373 | 12.4 | | |
| | | | | | 393 | 12.8 | | |
| | | | | | 413 | 13.5 | | |

TABLE 10-1

| | Partially alloyed steel powder (SP) (g) | Surface treatment agents (wt % to SP) | Graphite (GP) (g) | Surface treatment agents (wt % to GP) | Thermoplastic resin, thermoplastic elastomer or compounds having layered crystal structure (wt % to SP) | Measuring temperature (K.) | Flow rate (sec/100 g) | Compactibility 423 K, 686 MPa Green density ($Mg/m^3$) | Ejection force (MPa) |
|---|---|---|---|---|---|---|---|---|---|
| Prac. Ex. 49 | 1000 | e (0.02) | 6 | | iv (0.1) | 293 | 11.7 | 7.32 | 35.3 |
| | | | | | | 323 | 11.5 | | |
| | | | | | | 353 | 11.8 | | |
| | | | | | | 373 | 11.9 | | |
| | | | | | | 393 | 12.0 | | |
| | | | | | | 413 | 12.5 | | |
| Prac. Ex. 50 | 1000 | k (0.02) | 6 | g (0.5) | v (0.2) | 293 | 11.4 | 7.32 | 33.3 |
| | | | | | | 323 | 11.5 | | |
| | | | | | | 353 | 11.5 | | |

TABLE 10-1-continued

| | Partially alloyed steel powder (SP) (g) | Surface treatment agents (wt % to SP) | Graphite (GP) (g) | Surface treatment agents (wt % to GP) | Thermoplastic resin, thermoplastic elastomer or compounds having layered crystal structure (wt % to SP) | Measuring temperature (K.) | Flow rate (sec/100 g) | Compactibility 423 K, 686 MPa Green density ($Mg/m^3$) | Compactibility 423 K, 686 MPa Ejection force (MPa) |
|---|---|---|---|---|---|---|---|---|---|
| | | | | | | 373 | 11.7 | | |
| | | | | | | 393 | 11.9 | | |
| | | | | | | 413 | 12.3 | | |
| Prac. Ex. 51 | 1000 | g (0.02) | 6 | | x (0.1) | 293 | 11.5 | 7.33 | 37.1 |
| | | | | | | 323 | 11.5 | | |
| | | | | | | 353 | 11.6 | | |
| | | | | | | 373 | 11.7 | | |
| | | | | | | 393 | 12.0 | | |
| | | | | | | 413 | 12.7 | | |

TABLE 10-2

| | Partially alloyed steel powder (SP) (g) | Surface treatment agents (wt % to SP) | Graphite (GP) (g) | Surface treatment agents (wt % to GP) | Thermoplastic resin, thermoplastic elastomer or compounds having layered crystal structure (wt % to SP) | Measuring temperature (K.) | Flow rate (sec/100 g) | Compactibility 423 K, 686 MPa Green density ($Mg/m^3$) | Compactibility 423 K, 686 MPa Ejection force (MPa) |
|---|---|---|---|---|---|---|---|---|---|
| Prac. Ex. 45 | 1000 | c (0.02) | 6 | | xii (0.1) | 293 | 11.3 | 7.34 | 35.1 |
| | | | | | | 323 | 11.3 | | |
| | | | | | | 353 | 11.5 | | |
| | | | | | | 373 | 11.6 | | |
| | | | | | | 393 | 11.8 | | |
| | | | | | | 413 | 12.9 | | |

TABLE 11-1

| | Partially alloyed steel powder (SP) (g) | Graphite (g) | Surface treatment agents (wt % to SP) | Thermoplastic resin, thermoplastic elastomer or compounds having layered crystal structure (wt % to SP) | Measuring temperature (K.) | Flow rate (sec/100 g) | Compactibility 423 K, 686 MPa Green density ($Mg/m^3$) | Compactibility 423 K, 686 MPa Ejection force (MPa) |
|---|---|---|---|---|---|---|---|---|
| Prac. Ex. 53 | 1000 | 6 | c (0.03) | ii (0.1) | 293 | 11.8 | 7.31 | 34.2 |
| | | | | | 323 | 11.8 | | |
| | | | | | 353 | 11.9 | | |
| | | | | | 373 | 12.0 | | |
| | | | | | 393 | 12.2 | | |
| | | | | | 413 | 12.9 | | |
| Prac. Ex. 54 | 1000 | 6 | f (0.02) | iv (0.05) | 293 | 11.9 | 7.30 | 33.1 |
| | | | | xiii (0.05) | 323 | 11.9 | | |
| | | | | | 353 | 11.9 | | |
| | | | | | 373 | 12.1 | | |
| | | | | | 393 | 12.7 | | |
| | | | | | 413 | 13.2 | | |
| Prac. Ex. 55 | 1000 | 6 | h (0.03) | iv (0.1) | 293 | 11.9 | 7.33 | 30.1 |
| | | | | | 323 | 12.0 | | |
| | | | | | 353 | 12.0 | | |
| | | | | | 373 | 12.5 | | |
| | | | | | 393 | 12.8 | | |
| | | | | | 413 | 13.5 | | |

TABLE 11-2

| | Partially alloyed steel powder (SP) (g) | Graphite (GP) (g) | Surface treatment agents (wt % to SP) | Thermoplastic resin, thermoplastic elastomer or compounds having layered crystal structure (wt % to SP) | Measuring temperature (K.) | Flow rate (sec/100 g) | Compactibility 423 K, 686 MPa Green density ($Mg/m^3$) | Ejection force (MPa) |
|---|---|---|---|---|---|---|---|---|
| Prac. Ex. 56 | 1000 | 6 | j (0.01) | xiv (0.1) | 293 | 12.1 | 7.32 | 29.5 |
| | | | | | 323 | 12.5 | | |
| | | | | | 353 | 12.5 | | |
| | | | | | 373 | 12.7 | | |
| | | | | | 393 | 12.9 | | |
| | | | | | 413 | 13.9 | | |

TABLE 12

| | Partially alloyed steel powder (SP) (g) | Graphite (GP) (g) | Surface treatment agents (wt % to SP) | Thermoplastic resin, thermoplastic elastomer or compounds having layered crystal structure (wt % to SP) | Measuring temperature (K.) | Flow rate (sec/100 g) | Compactibility 423 K, 686 MPa Green density ($Mg/m^3$) | Ejection force (MPa) |
|---|---|---|---|---|---|---|---|---|
| Prac. Ex. 57 | 1000 | 6 | b (0.02) | i (0.1) | 293 | 11.9 | 7.32 | 28.7 |
| | | | | | 323 | 12.0 | | |
| | | | | | 353 | 12.0 | 7.32 | 28.7 |
| | | | | | 373 | 12.2 | | |
| | | | | | 393 | 12.5 | | |
| | | | | | 413 | 13.0 | | |
| Prac. Ex. 58 | 1000 | 6 | d (0.03) | v (0.1) | 293 | 12.0 | 7.33 | 26.5 |
| | | | | | 323 | 12.0 | | |
| | | | | | 353 | 12.0 | | |
| | | | | | 393 | 12.7 | | |
| | | | | | 413 | 13.5 | | |
| Prac. Ex. 59 | 1000 | 6 | h (0.02) | vi (0.1) | 293 | 11.8 | 7.31 | 20.1 |
| | | | | | 323 | 12.0 | | |
| | | | | | 353 | 11.9 | | |
| | | | | | 373 | 12.4 | | |
| | | | | | 393 | 12.7 | | |
| | | | | | 413 | 13.0 | | |

TABLE 13-1

| | Partially alloyed steel powder (SP) (g) | Graphite (GP) (g) | Surface treatment agents (wt % to SP) | Measuring temperature (K.) | Flow rate (sec/100 g) | Compactibility 423 K, 686 MPa Green density ($Mg/m^3$) | Ejection force (MPa) |
|---|---|---|---|---|---|---|---|
| Prac. Ex. 60 | 1000 | 6 | c (0.03) | 293 | 11.5 | 7.33 | 31.0 |
| | | | | 323 | 11.5 | | |
| | | | | 353 | 11.6 | | |
| | | | | 373 | 11.7 | | |
| | | | | 393 | 11.8 | | |
| | | | | 413 | 11.9 | | |
| Prac. Ex. 61 | 1000 | 6 | f (0.04) | 293 | 11.4 | 7.35 | 29.7 |
| | | | | 323 | 11.5 | | |
| | | | | 353 | 11.6 | | |
| | | | | 373 | 11.6 | | |
| | | | | 393 | 11.9 | | |
| | | | | 413 | 12.7 | | |
| Prac. Ex. 62 | 1000 | 6 | m (0.01) | 293 | 11.8 | 7.34 | 32.3 |
| | | | | 323 | 11.9 | | |
| | | | | 353 | 11.9 | | |
| | | | | 373 | 12.0 | | |

TABLE 13-1-continued

| | Partially alloyed steel powder (SP) (g) | Graphite (GP) (g) | Surface treatment agents (wt % to SP) | Measuring temperature (K.) | Flow rate (sec/100 g) | Compactibility 423 K, 686 MPa Green density ($Mg/m^3$) | Ejection force (MPa) |
|---|---|---|---|---|---|---|---|
| | | | | 393 | 13.0 | | |
| | | | | 413 | 13.5 | | |

TABLE 13-2

| | Partially alloyed steel powder (SP) (g) | Graphite (GP) (g) | Surface treatment agents (wt % to SP) | Measuring temperature (K.) | Flow rate (sec/100 g) | Compactibility 423 K, 686 MPa Green density ($Mg/m^3$) | Ejection force (MPa) |
|---|---|---|---|---|---|---|---|
| Prac. Ex. 63 | 1000 | 6 | j (0.01) | 293 | 11.8 | 7.33 | 31.5 |
| | | | | 323 | 11.8 | | |
| | | | | 353 | 11.7 | | |
| | | | | 373 | 11.9 | | |
| | | | | 393 | 12.5 | | |
| | | | | 413 | 12.8 | | |

TABLE 14

USED SURFACE TREATMENT AGENT

| GENERAL TERMS | SYMBOLS | NAMES |
|---|---|---|
| Organoalkoxysilane | a | γ- methacryloxypropyl trimethoxy silane |
| | b | γ-glycidoxypropyl trimethoxy silane |
| | c | N-β (aminoethyl) γ-trimethoxy silane |
| | d | Methyl trimethoxy silane |
| | e | Phenyl trimethoxy silane |
| | f | Diphenyl dimethoxy silane |

TABLE 14-continued

USED SURFACE TREATMENT AGENT

| GENERAL TERMS | SYMBOLS | NAMES |
|---|---|---|
| Fluorine-contained silicon silane coupling agent | g | 1H, 1H, 2H, 2H-henicosafluoro trimethoxy silane |
| Organosilazane | h | Polyorgano silazane |
| Titanate coupling agent | i | Isopropyltriisostearoyl titanate |
| Alkylbenzene | j | Alkylbenzene |
| Silicone oil | k | Dimethyl silicone oil |
| | l | Methylphenyl silicone oil |
| | m | Fluorine-modified silicone oil |

TABLE 15

USED COMPOUNDS HAVING LAMIMER CRYSTAL STRUCTURE, THERMOPLASTIC RESIN AND THERMOPLASTIC ELASTOMER

| GENERAL TERMS | SYMBOLS | NAMES |
|---|---|---|
| Inorganic compounds having layered crystal structure | i | Graphite |
| | ii | Carbon fluoride |
| | iii | $MoS_2$ |
| Organic compounds having layered crystal structure | iv | Melamine-cyanuric acid addition compound |
| | v | N-alkylasparatic acid-β-alkylester |
| Thermoplastic resin | vi | Polystyrene powder |
| | vii | Nylon powder |
| | viii | Polyethyrene powder |
| | iv | Fluorine-contained resin powder |
| Thermoplastic elastomer | x | Polystyrene-acryl copolymer |
| | xi | Olefin thermoplastic elastomer |
| | xii | SBS thermoplastic elastomer |
| | xiii | Silicone thermoplastic elastomer |
| | xiv | Polyamide thermoplastic elastomer |

Notes: SBS = ABBREVIATION of polystyrene-polybutadiene-polystyrene

Industrial Applicability

The present invention is suitably applicable to iron-based powder composition for powder metallurgy in which lubricant, graphite powder, copper powder and the like are added and mixed. The iron-based powder composition for powder metallurgy in normal handling undergoes little segregation and dust generation and has stable flowability and excellent compactibility in a wide temperature range over the order of the room temperature to 473 K, and particularly, is excellent in a warm compactibility.

We claim:

1. An iron-based powder composition for powder metallurgy excellent in flowability and compactibility, comprising a mixture including an iron-based powder and alloying powders in a total amount of 99 wt. % or more, and the balance being lubricants, binders and a surface treatment agent, and wherein at least a part of the powders of the mixture comprises powders coated with the surface treatment agent that is present in an amount of 0.04 wt. % or less.

2. An iron-based powder composition for powder metallurgy excellent in flowability and compactibility, according to claim 1, wherein said surface treatment agent is organosilicon compounds.

3. An iron-based powder composition for powder metallurgy excellent in flowability and compactibility, according to claim 2, wherein said organosilicon compounds are organoalkoxysilane, organosilazane or a silicone oil.

4. An iron-based powder composition for powder metallurgy excellent in flowability and compactibility, according to claim 3, wherein substitutions for organic group of said organoalkoxysilane are acrylic group, epoxy group, and amino group.

5. An iron-based powder composition for powder metallurgy excellent in flowability and compactibility, according to claim 3, wherein said organosilazane is polyorganosilazane.

6. An iron-based powder composition for powder metallurgy excellent in flowability and compactibility, according to claim 1, characterized in that said surface treatment agent is a titanate-containing coupling agent or a fluorine-containing silicon silane coupling agent.

7. An iron-based powder composition for powder metallurgy excellent in flowability and compactibility, according to claim 1, wherein said surface treatment agent is a mineral oil.

8. An iron-based powder composition for powder metallurgy excellent in flowability and compactibility, according to claim 7, wherein said mineral oil is alkylbenzene.

9. An iron-based powder composition for powder metallurgy excellent in flowability and compactibility, according to claim 1, wherein said lubricant is an inorganic or organic compound having layered a crystal structure.

10. An iron-based powder composition for powder metallurgy excellent in flowability and compactibility, according to claim 9, wherein said inorganic compound having layered crystal structure is graphite, carbon fluoride or $MoS_2$.

11. An iron-based powder composition for powder metallurgy excellent in flowability and compactibility, according to claim 9, wherein said organic compound having a layered crystal structure is melamine-cyanuric acid adduct or N-alkylasparatic acid-β-alkylester.

12. An iron-based powder composition for powder metallurgy excellent in flowability and compactibility, according to claim 1, wherein said lubricant is a thermoplastic resin.

13. An iron-based powder composition for powder metallurgy excellent in flowability and compactibility, according to claim 12, wherein said thermoplastic resin is polystyrene, nylon, polyethyrene or fluorine-contained resin, each having a particle diameter of 30 μm or less.

14. An iron-based powder composition for powder metallurgy excellent in flowability and compactibility, according to claim 1, wherein said lubricant is a thermoplastic elastomer having a particle diameter of 30 μm or less.

15. An iron-based powder composition for powder metallurgy excellent in flowability and compactibility, according to claim 14, wherein said thermoplastic elastomer is a styrene block copolymer (SBC), a thermoplastic elastomer olefin (TEO), a thermoplastic elastomer polyamide (TPAE) or a silicone elastomer.

16. An iron-based powder composition for powder metallurgy excellent in flowability and compactibility, according to claim 1, wherein said lubricant is a metallic soap having a melting point not less than 423 K.

17. An iron-based powder composition for powder metallurgy excellent in flowability and compactibility, according to claim 1, wherein said binding agent is a fatty acid amide.

18. An iron-based powder composition for powder metallurgy excellent in flowability and compactibility, according to claim 17, wherein said fatty acid amide is a fatty acid monoamide, a fatty acid bisamide, or mixtures thereof.

19. A method of making an iron-based powder composition for powder metallurgy having excellent flowability and compactibility, comprising:

combining metallic powders including an iron-based powder and alloying powders in a total amount of 99 wt. % or more, and the balance being lubricants, binders and a surface treatment agent, to form a mixture, and wherein at least a part of the powders of the mixture comprises powders coated with the surface treatment agent that is present in an amount of 0.04 wt. % or less.

* * * * *